US005373971A

United States Patent [19]

Laffy et al.

[11] Patent Number: 5,373,971

[45] Date of Patent: Dec. 20, 1994

[54] ASEPTIC CONTAINER FOR HOLDING AND DISPENSING A STERILE LIQUID OR SEMI-LIQUID PRODUCT

[76] Inventors: Raoul Laffy, 8 Villas des Peupliers, 92200 Neuilly/Seine; Pierre Laffy; A., 215 Rue Henri Ravera, 92220 Bagneux, both of France

[21] Appl. No.: 986,714

[22] Filed: Dec. 8, 1992

Related U.S. Application Data

[63] Continuation-in-part of Ser. No. 563,504, Aug. 7, 1990, abandoned.

[30] Foreign Application Priority Data

Jan. 11, 1990 [FR] France ..... 90 00292
Jan. 30, 1992 [FR] France ..... 92 01027

[51] Int. Cl.[5] ..... B65D 88/58

[52] U.S. Cl. ..... 222/189; 222/320; 222/387

[58] Field of Search ..... 222/205, 319, 320, 386, 222/405, 387, 189

[56] References Cited

U.S. PATENT DOCUMENTS

| | | | |
|---|---|---|---|
| 589,965 | 9/1897 | Gonorovsky | 222/320 X |
| 1,217,663 | 2/1917 | Taylor | 222/320 X |
| 1,754,668 | 4/1930 | Cary | 222/320 X |
| 2,269,371 | 1/1942 | Hammerschmidt et al. | 222/320 |
| 2,341,031 | 2/1944 | Flynn | 222/320 |
| 2,618,414 | 11/1952 | Matlas | 222/320 |
| 2,732,101 | 1/1956 | Söhn | 222/320 |
| 2,915,225 | 12/1959 | Atkins | 222/320 |
| 4,308,977 | 1/1982 | Sigmund et al. | 222/320 |
| 4,805,810 | 2/1989 | Czetwertynski | 222/319 |
| 4,821,926 | 4/1989 | Battegazzore | 222/387 X |
| 5,105,993 | 4/1992 | LaHay et al. | 222/189 |

FOREIGN PATENT DOCUMENTS

| | | | |
|---|---|---|---|
| 1027484 | 5/1953 | France | 222/320 |
| 2643616 | 8/1990 | France | 222/387 |
| 2656854 | 7/1991 | France . | |
| 3226835 | 1/1984 | Germany | 222/319 |
| 409828 | 5/1934 | United Kingdom | 222/320 |
| 411573 | 6/1934 | United Kingdom | 222/320 |

*Primary Examiner*—Andres Kashnikow
*Assistant Examiner*—Kenneth Bomberg
*Attorney, Agent, or Firm*—McAulay Fisher Nissen Goldberg & Kiel

[57] ABSTRACT

This invention relates to an aseptic recipient or bottle containing a non-pasty product, comprising a body with a cylindrical or prismatic lateral wall, obturated at one end by a bottom and presenting an outlet orifice for evacuation of the product, and an internal mobile piston rubbing in tight manner against the inner surface of the lateral wall of the recipient and defining a volume containing the product. In order to prevent the germs and bacteria present in the ambient air from penetrating inside the product and contaminating it, structure is provided for exerting on the piston, upon each use, a sufficient force to push the piston in the direction of the outlet orifice and consequently for exerting on the product a pressure ensuring that the desired quantity of product is evacuated, and non-return structure maintains the piston, after the force exerted to evacuate the product has stopped, in the position attained so as to conserve a permanent residual pressure in the product.

3 Claims, 3 Drawing Sheets

ASEPTIC CONTAINER FOR HOLDING AND DISPENSING A STERILE LIQUID OR SEMI-LIQUID PRODUCT

CROSS REFERENCE TO RELATED APPLICATIONS

This application is a continuation-in-part of application Ser. No. 07/563504 filed on Aug. 7, 1990 now abandoned.

FIELD OF THE INVENTION

The present invention relates to an aseptic container for containing a sterile liquid or semi-liquid product.

BACKGROUND OF THE INVENTION

In numerous domains, containers such as bottles, flasks, pots, boxes, cans, etc. . . . , containing liquid or semi-liquid products, are used; such containers may be used in the health domain for containing medicines, isotonic solutions, disinfectants or agents protecting against infection, etc. . . . ; in the field of cosmetics, beauty creams, etc. . . . ; in the domain of foodstuffs, various drinks, wines, fruit juices, syrups, various sauces, jams . . . , in other domains, varnishes, paints. . . . Such containers generally comprise an outlet orifice obturated by a mobile obturator (lid, stopper, capsule, etc. . . . ). When using such a product contained in the recipient, once the obturator has been removed, the product flows by itself through the outlet orifice, and air then penetrates inside the recipient to fill the space left by the quantity of liquid used. As a result, the oxygen and the germs, bacteria, microbes, etc. . . . , which are normally present in the air, are introduced into the recipient and, after a certain time, they cause an alteration (pollution, fermentation, oxidation) of the product contained in the recipient, or, simply, the air dries the product or takes away its aroma with the result that this product becomes more or less rapidly unsuitable for use. In order to avoid such pollution, preservatives are used, which are sometimes noxious, as in the case of ophthalmological products, or preservatives and antioxidants as in the case, for example, of cosmetic products.

It is an object of the present invention to overcome this drawback by providing a container of particularly simple structure which prevents, during use, any admission of air therein and possibly even any contact of the product with the air, ensuring that the product which it contains is not altered over a long period of time without using a preservative or antioxidant as is the general case.

SUMMARY OF THE INVENTION

The present invention relates to an aseptic container, for containing a sterile liquid or semi-liquid product, said container comprising a body having a lateral wall obturated, at one end, by an end wall and an outlet orifice including a narrow passage for evacuation of the product and open to ambient air, an internal mobile piston made of elastic material, said piston being deformable under the action of pressure exerted thereby, said piston being slidable within and in contact with said lateral wall, in a tight manner, against the inner surface of the lateral wall of said body, and said piston, said lateral wall and said end wall defining a containing volume for containing the product, an outlet tube coupled between said containing volume and said outlet orifice, means for exerting a sufficient force on the piston, causing the volume to decrease and thereby expelling a desired quantity of the product from said containing volume, through said outlet orifice, non-return means for maintaining said piston in its final position after the force exerted has stopped, for generating and holding a permanent residual pressure, in the product, said residual pressure being due firstly to the deformation of the piston and of the lateral and end walls of the container, secondly to the capillarity forces generated by the narrow passage of the outlet orifice, and thirdly to said non-return, means residual pressure preventing germs and bacteria present in the ambient air from penetrating into the product and contaminating it.

When the force exerted on the piston ceases, the product automatically stops flowing to the outside due to the tightness of the piston, retained in place, on one hand, and to the non-return means, on the other hand, and the piston-product interface is not placed at atmospheric pressure, a condition indispensable for the product to be able to leave the container without force exerted on the piston. In order to evacuate the product under these conditions, a vacuum would have to be created at the piston-product interface, which would necessitate a considerable tensile force.

Experiments carried out by the Institut Pasteur, developed hereinbelow, prove that the bacteria and germs do not penetrate in the product retained inside the container and that this product remains sterile for an unlimited period. Nevertheless, a manual or automatic obturator may in addition be used designed so that, upon each use, it cuts the product leaving through the orifice upstream of the last drop, with the result that the product remaining in the container has never been in contact with air even in the course of use, thus reinforcing the sterility of pouring.

The aseptic container according to the invention thus offers the advantage that the product contained therein cannot be polluted, altered, subject to oxidation or fermentation, dried or lose its aroma, which allows the product to be conserved for a very long time.

BRIEF DESCRIPTION OF THE DRAWINGS

The invention will be more readily understood on reading the following description with reference to the accompanying drawings, in which.

BEST MODES FOR CARRYING OUT THE INVENTION

Figure 1:
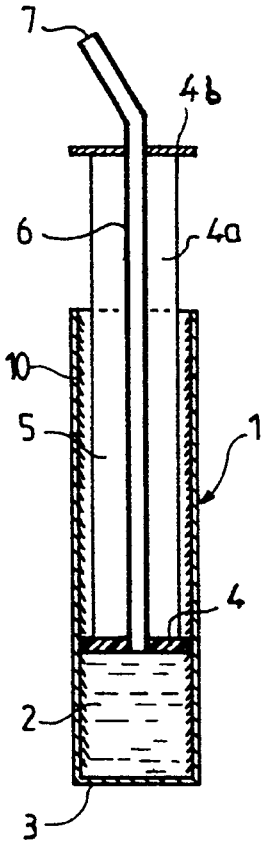
FIG. 1 is a view, in axial and vertical section, of an aseptic container according to the invention.

Referring now to the drawings, FIG. 1 shows an aseptic container 1 containing a liquid 2 having to be protected from any contamination by the germs, bacteria, etc. . . . present in the ambient air. Container 1 comprises a body with lateral wall in cylindrical or prismatic form, opened at its upper part and closed by an end wall or bottom 3 in its lower part. Container 1 contains an internal mobile piston 4 made of elastic material, rubbing in tight manner on the inner surface of the lateral wall of the container and separating the inner volume of the container into two parts, namely an upper part 5 in contact with the open air and a lower volume containing the liquid 2, said volume being defined by the piston 4, the lateral wall 1 and the end wall or bottom 3. In this embodiment, the tight piston 4 is fast with a piston rod 4a whose cross-section is in the form of a three-armed star and which extends upwardly and outwardly of the recipient 1, passing through the upper orifice thereof which is open. The piston rod 4a is fast, at its upper end which projects outside the body of the container 1, with an enlarged head 4b serving as pusher for actuating the piston 4. In a variant embodiment, the head forming pusher 4b may, in initial position, i.e. the recipient being completely filled with the product, lie slightly inside the body of the container. Consequently, the head forming pusher 4b can only be pushed progressively inside the container and not drawn outwardly. A narrow tube 6 provided for the evacuation of the liquid extends axially along the piston rod 4a; it traverses, at its inner end, the tight piston 4 and opens out in the lower volume containing the liquid 2, and it constitutes, at its upper end, an outlet orifice 7 which, in this embodiment, is left free. Furthermore, the container according to the invention is provided with nonreturn means which are either associated to the tight piston 4, as detailed below, or provided on any part of the wall of the container 1. For example said non-return means may comprise projections 10, such as downwardly oriented teeth, catches, notches . . . provided on the inner surface of the lateral wall and blocking the piston 4 against any movement toward the upper open end of the body of the container 1.

The vertical outlet tube 6 which may equally well be eccentric or lateral on the outside, on the body of the container, may be used in any of the different embodiments of the aseptic container according to the invention and in particular those described in detail hereinbelow.

Tests have been made by the Institut Pasteur with a container as shown in FIG. 1 filled with a liquid 2 constituted by a thioglycolate culture medium (TCM) which allows the growth both of aerobic and anaerobic bacteria. Physiological salt solutions (substantially identical to organic liquids, tears, saliva, exsudates) are artificially contaminated in tapered beakers with germs hereinafter issuing from culture on agar-agar and of which the germs have been counted:

Group a:

1) Escherichia coli, $10^3$/ml
2) Pseudomonas aeruginosa, $10^3$/ml
3) Salmonella typhimurium, $10^3$/ml These germs are mobile and may propagate by contact.

Group b:

1) Staphylococcus aureus, $10^6$/ml
2) Streptococcus fecalis, $10^6$/ml responsible for suppurations.

Group c: as well as two fungi:

1) Candida albicans
2) Aspergillus niger

TEST I

Each of the germs of the three groups was used individually.

The drops of TCM from the flask were deposited 6 times consecutively at 1 hourly intervals, as under normal conditions of use but particularly severe, in contact with the surface of the physiological salt solution contaminated. The culture medium of the flask, the drops and the contaminated physiological salt solution are therefore in direct contact, thus making it possible to verify the conservation of sterile pouring during use.

The inner medium is then completely expelled into a sterile tube and placed in an oven at 37° C. for 48 hours.

TEST II

The germs of group a 1+2+3, then of group b 1+2, then of group c 1+2, were mixed and the experiment re-run under the same conditions but, for mixtures a, b or c, the inner liquid was not expelled but conserved in an oven at 37° C. for 21 days.

RESULT

TEST I

Germs of group a:

1)=negative after 48 hrs.; 2) idem; 3) idem.

Germs of group b:

1) negative after 48 hrs.; 2) idem

Germs of group c:

1) negative after 5 days; 2) idem after 5 days.

TEST II

Mixture of group a equal after 15 days, no cloudiness in the dispensing flask. The contents were then spread out on PTV agar-agar dishes.

There was no colony after 48 hours' dwell time of these dishes in the oven at 37° C.

The results were identical for mixtures b and c.

The conclusions of the above tests, under experimental conditions similar to normal use, were that a good sterile conservation inside the liquid conserving flask of a very sensitive culture medium is obtained. This sterility of the contents of the flask is total and unlimited in time and the sterility of pouring, during use, is completely guaranteed.

Figure 2:
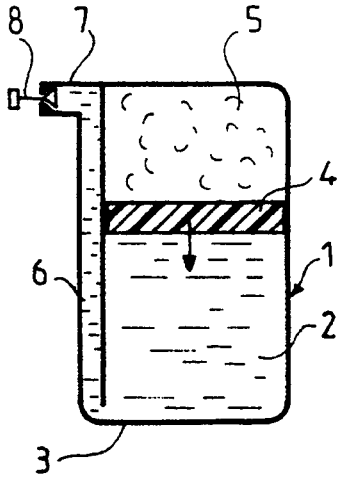
FIGS. 2 to 7 are views, in axial and vertical section, of variant embodiments of the aseptic container.

In the variant embodiment shown in FIG. 2, the piston 4 defines an upper volume 5 which, in that case, contains a gas under pressure. The piston 4 is thus permanently pushed downwardly under the effect of the pressure of the compressed gas in the upper volume 5 which thus performs the role of a non-return device whilst maintaining a permanent residual pressure on the product. In that case, the liquid is evacuated via a lateral plunger tube 6 (which may possibly be central or eccentric), which is adjacent the lateral wall of the container 1 or moulded therewith. Tube 6 opens out, at its lower end, in the vicinity of the bottom 3 of the container and its upper end constitutes an outlet orifice 7 of the container in which may be housed a manually or automatically controlled obturator 8. This obturator device 8 is preferably designed particularly for ophthalmological products, so that it cuts the jet of liquid leaving the container upstream of the last drop. In this way, none of the liquid 2 remaining in the recipient is ever in contact with the air, even at the outlet orifice 7, thus giving an additional guarantee of sterility of pouring.

When it is desired to use part of the liquid 2 contained in the container 1, the obturator 8 is manoeuvred so as to open the outlet orifice 7. Under the effect of the pressure of the gas prevailing in the upper volume 5, the liquid 2 is delivered upwardly inside the tube 6 and flows without pulverization to the outside, through the outlet orifice 7. When the desired quantity of liquid has been dispensed, the obturator 8 is closed manually or automatically and it interrupts the flow of the liquid to the outside, without leaving any volume of air trapped at the upper end of the tube 6, i.e. just below obturator 8. The liquid 2 is therefore perfectly protected from any contamination by germs present in the ambient air and from any oxidation, desiccation or loss of aroma of the liquid by the air.

The pressurized gas may freely fill the upper volume 5 as shown in FIG. 2 or be contained in a simple bag. However, according to a variant embodiment, this gas, which may be air, may be introduced and raised in pressure by a manual piston pump, either directly in the upper volume 5 or in a supple bag housed in this volume 5.

Figure 3:
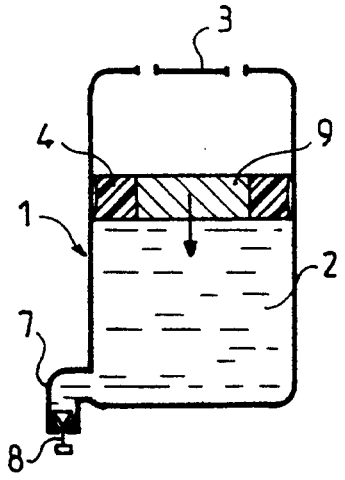

FIG. 3 illustrates a variant embodiment of the aseptic container shown in FIG. 1 in which the mobile piston 4 is subjected, not to the pressure of a compressed gas, but to the force of a weighty mass 9 with which it is fast. This weighty mass 9 exerts on the mobile piston 4 a downward vertical force which provokes a progressive downward displacement of the piston 4 and a regular evacuation of the stream of liquid through the outlet orifice 7 which is, in that case, in lower position and which maintains a permanent residual pressure thus preventing any contamination of the liquid. To enable the weighty mass 9 to exert the downward vertical force on piston 4, the volume located above this mass must be at atmospheric pressure. To that end, either the bottom 3 of the container may be eliminated or holes may be pierced in this bottom to ensure contact with the open air.

The weighty mass 9 is preferably integrated with the piston 4 which in that case presents an elastic part only on its periphery, thus forming an elastic ring for retention by friction.

Figure 4:
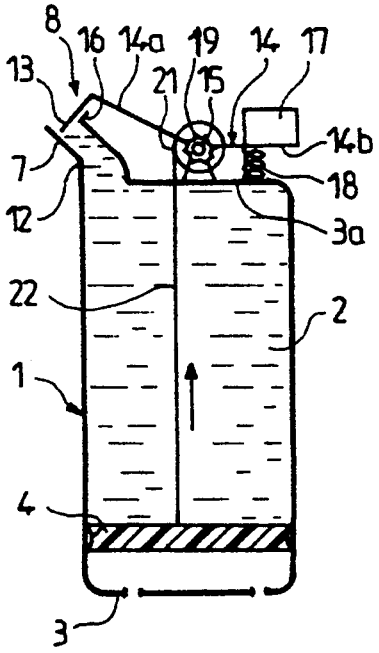

In the variant embodiment of the container according to the invention shown in FIG. 4, the outlet orifice 7 for the liquid is provided at the end of a tube 12 issuing from the upper front wall 3*a* of container 1. The outlet orifice 7 is obturated by a flap 13 of the obturator device 8 which is fast with an arm 14*a* of a two-armed lever 14, articulated about a horizontal pin 15 borne by the upper front wall 3*a* of the container. The closure flap 13 and arm 14*a* are arranged so that, when arm 14*a* pivots about axis 15, the flap 13 makes a movement perpendicular to the axis of the tube 12 and the outlet orifice 7. This outlet orifice 7 is extended upwardly by a lip 16 fast with the tube 12 and along which slides the obturator flap 13. In this way, the inner face of the obturator flap 13, which is in contact with the liquid located in tube 12 in closed position, slides in contact with the lip 16 towards its position of opening and, consequently, it is never in contact with the air, which ensures that liquid 2 is maintained in the sterile state. The obturator device 8 is actuated by a manoeuvring knob 17 which is fast with the other arm 14*b* of lever 14 opposite arm 14*a*. Arm 14*b* and the manoeuvring knob 17 are urged upwardly, in normal position of closure, by a spring 18. The container of FIG. 4 also comprises a device 19, of the pawl and ratchet type, to provoke, whenever pressure is exerted on the manoeuvring knob 17, a partial rotation of a wheel 21 on which is wound a yarn or strap 22. This yarn 22 passes through a tight hole provided in the upper front wall 3*a* of the container, it extends substantially axially to the inside of the container 1 and it is hooked, at its lower end, to the piston 4 lying in starting position, i.e. when the recipient 1 is full of liquid 2, in the vicinity of the lower bottom 3 comprising at least one orifice for communication with the atmosphere. Consequently, when the user presses on the manoeuvring knob 17, the lever 14 is pivoted in a clockwise direction about horizontal axis 15. During the stroke of knob 17, the obturator flap 13 moves upwardly along lip 16 so as to open the outlet orifice 7. Sealing means are provided to prevent, in the course of this movement, the inner face of the obturator flap 13 from coming into contact with the ambient air. These means may be of the type described hereinafter in the embodiment illustrated in FIG. 7. Furthermore, knob 17 controls pawl and ratchet device 19 in order to rotate wheel 21 and to exert a traction on the yarn 22 which then draws the piston 4 upwardly by a short distance, which ensures the dispensing of the desired quantity of liquid whilst maintaining a permanent residual pressure in the product, preventing any contamination. When the user releases manoeuvring knob 17, the obturation flap 13 is returned into closed position by spring 18, cutting the stream of liquid upstream of the last drop, and the pawl and ratchet device 19 allows this movement. With a container of this type, an upward displacement of the piston 4 is therefore obtained.

According to a variant embodiment, the obturator flap 13 comprises a ball which obturates the outlet orifice 7 of the container, when the obturator device 8 is closed.

Figure 5:
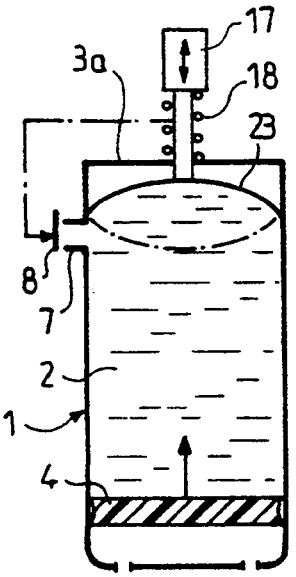

In the variant embodiment shown in FIG. 5, the manoeuvring knob 17 which is mounted mobile on the upper front wall 3*a* of the container, acts, directly or indirectly, on an elastic deformable membrane 23, resuming its initial position after deformation, housed in the upper part of container 1, below its upper front wall 3*a*. Consequently, when manoeuvring knob 17 is pressed, the obturator device 8 is opened, pushing membrane 23 downwardly (position shown in dashed and dotted lines), which creates a pressure on the liquid 2 sufficient to cause this liquid to evacuate through the open outlet orifice 7. When the user releases manoeuvring knob 17, the latter, on rising under the action of a possible return spring 18, enables the membrane 23 to return into its initial position, shown in solid lines in FIG. 5. This then provokes a depression in container 1 and piston 4, which lies in the lower part of the container, is then drawn upwardly over a short distance, in order to compensate the volume of liquid dispensed from the container, whilst maintaining a permanent residual pressure in the product, avoiding any contamination. The piston 4 comprises, on its lower part, non-return means preventing it from sliding downwardly, in particular upon deformation of the membrane 23.

Figure 6:
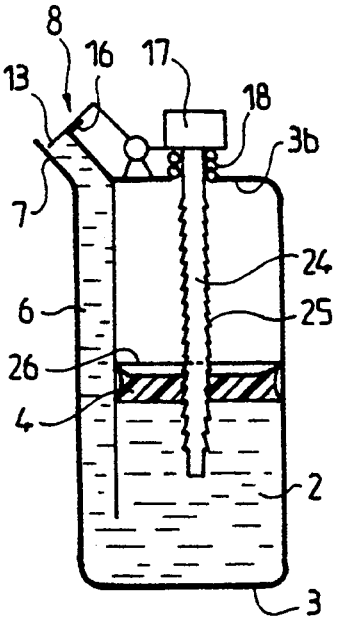

In the variant embodiment shown in FIG. 6, piston 4 lies, at the start, in the upper part of the container and it is actuated by a rod 24 extending upwardly through an upper cap 3*b* of container 1. This rod 24, provided with downwardly oriented notches 25, is fast, at its upper end, with manoeuvring knob 17 and it passes through the upper cap 3*b* and piston 4. Consequently, when the user presses on knob 17, the notches 25 of rod 24 take piston 4 towards the lower bottom 3 to deliver the liquid through the outlet orifice 7, creating a permanent residual pressure in the product, preventing any contamination. When the pressure on manoeuvring knob 17 is released, this knob and rod 24 rise under the action of the return spring 18. However, the piston remains immobilized in its previous position, under the action of non-return means constituted, in this particular case, by a peripheral retaining lip 26 which is provided on the upper face of piston 4 and which is in contact with the inner face of container 1. This retaining lip 26 opposes any upward displacement of piston 4.

Figure 7:
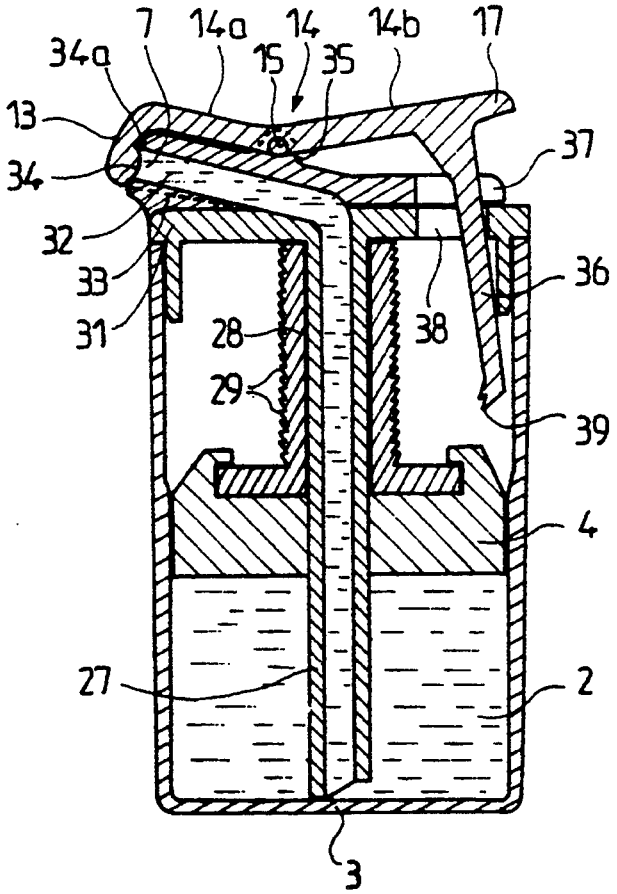

FIG. 7 shows a variant embodiment of the container of the type in which piston 4 is traversed by a vertical immersed tube 27. This tube 27 may extend along the axis of the piston, as shown in FIG. 7, or it may be offset laterally with respect to this axis. The upper part of this tube 27 serves as member for guiding a rod 28 fast with the piston and which presents, on its outer lateral surface, notches or a thread 29. Rod 28 is pierced axially and traversed by tube 27 which issues from an upper cap 31. Tube 27 is extended upwardly by a conduit 32 towards the top of the container. This conduit 32 is formed in a joining piece 33 borne by cap 31. The outlet orifice 7 which is constituted by the end of the inclined conduit 32, is obturated by a flap 13 which presents, opposite orifice 7, a boss 34 engaging in this orifice in order to close it. The obturator flap 13 forms one piece with the arm 14*a* of a two-armed lever 14 which is articulated about a horizontal pin 15. This pin is borne by a projection 35 fast with the joining piece 33. The other arm 14*b* of lever 14 forms, at its end, the manoeuvring knob 17 and it is extended downwardly by a lug 36, 37. This lug 36 presents, at its lower end, one or more teeth 39 intented to act on the notches 29 of rod 28. Consequently, when the user presses on the manoeuvring knob 17, lever 14 is pivoted in a clockwise direction about axis 15. At the beginning of the pivoting stroke of lever 14, the obturator flap 13 slides on the wall so that the boss 34 is not in contact with the air and releases the orifice 7 of conduit 32, so that this orifice is then open to allow the liquid 2 to be evacuated.

As lever 14 continues to pivot, the teeth 39 of lug 36 come into contact with notches 29 of rod 28 so that the lug 36 is then coupled with this rod 28. Its continued downward movement consequently causes a slight descending movement of the rod 28 and of the piston 4, in order to ensure evacuation of the liquid and to maintain a permanent residual pressure in the liquid, preventing any contamination. When the user stops exerting a pressure on the manoeuvring knob 17, lever 14 returns by itself into the position shown in FIG. 7, under the action of elastic means (not shown), the obturator flap 13 then closing outlet orifice 7, cutting the stream of liquid upstream the last drop and without the boss 34 having been in contact with the air, thus giving an additional guarantee of sterility of pouring.

The movement of axial slide of piston 4 inside container 1 may naturally be obtained by any movement-transmission device well known in the art, comprising in particular a toothed wheel adapted to be driven in rotation from outside the container and coupled to an axially mobile piston rod.

Figure 8:
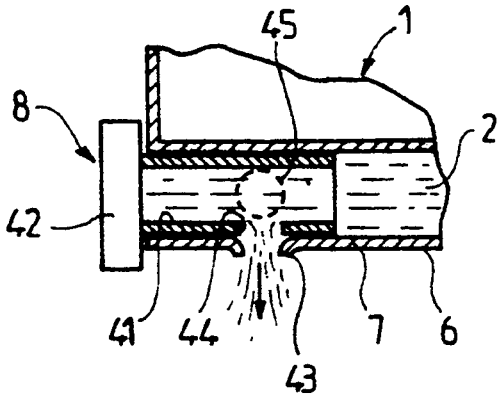
FIGS. 8 and 9 are views, in section, of an embodiment of a device obturating the container, this obturator device being shown in open and closed position respectively.
Figure 9:
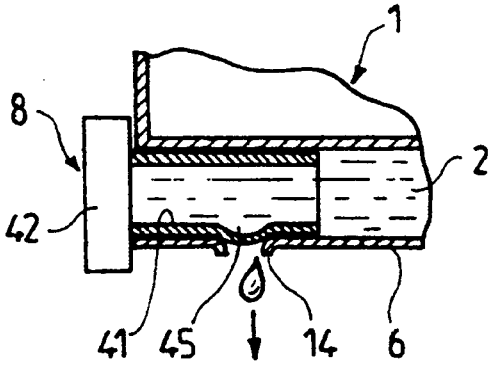

By way of example in the embodiment shown in FIGS. 8 and 9, another type of obturator device 8 comprises a sleeve 41 fast with an outer manoeuvring knob 42 and which is closely engaged in the end of a horizontal tube constituting the outlet orifice 7 of container 1 which, in that case, lies horizontally, the manoeuvring knob 42 hermetically obturating orifice 7 of tube 6. This tube is pierced, in its lower part, with a hole 43 for the evacuation of the liquid and, in the transverse plane where this hole 43 lies, sleeve 41 presents, on the one hand, at least one opening 44 and, on the other hand, at least one outer boss 45 elastically rubbing on the inner wall of tube 6. Consequently, when sleeve 41 is placed in a position such that its opening 44 is located opposite hole 43, as shown in FIG. 8, the obturator device 8 is open and the liquid can flow continuously in the form of drops or a stream. To close the container, it suffices to rotate sleeve 41 (possibly by a rigid connection as in the preceding devices) so that boss 45 comes into position opposite hole 43, as shown in FIG. 9. Due to the elasticity of the material constituting sleeve 41, boss 45 then engages in hole 43 and it provokes expulsion of the small quantity of liquid which remains between the outer surface of sleeve 41 and the wall of hole 43. Boss 45 also ensures elastic locking of the obturator device 8 in closed position.

Figure 10:
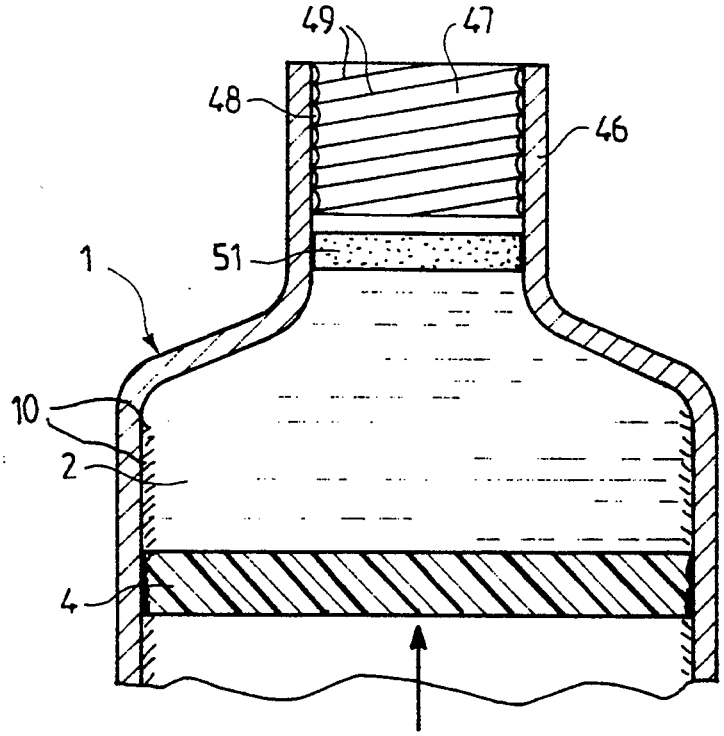
FIGS. 10 to 13 are views in axial and vertical section of further variant embodiments of the aseptic container.

In the variant embodiment shown in FIG. 10, the container 1 comprises, at its upper end, and outlet tube 46 which is obturated by a stopper 47 shaped so as to define one or more narrow passages or restrictors 48 establishing communication between the internal volume of the container 1 containing the liquid 2 and the outlet orifice of tube 46. The or each restrictor may be constituted by holes of small diameter made right through the stopper. The length and transverse section of the narrow passage or restrictor are adjusted as a function of the desired residual pressure and flowrate and said passage may be of any shape, for example rectilinear, helicoidal, in a broken line, as a baffle, etc. . . .

In the embodiment shown in FIG. 10, the narrow flow passage or restrictor 48 is formed between the peripheral outer surface of the stopper 47 and the inner surface of the outlet tube 46. This passage has a transverse section of flow ranging from some tenths to some hundredths of square millimeter, and it is constituted by a groove of helicoidal form. This groove is defined between the smooth inner surface of the outlet tube 46 and the outer surface of the stopper 47 made in the form of a screw presenting one or more screw threads 49.

It goes without saying that the reverse arrangement may also be adopted, i.e. providing a stopper 47 with a smooth outer lateral surface and an inner threading provided on the inner surface of the outlet tube 46. The narrow passage or restrictor may also be constituted by one or more grooves having any shape.

Despite the considerable residual pressure obtained thanks to the existence of the restrictor 48, as defined above, in the outlet tube 46, the liquid 2 contained in the recipient 1 cannot flow to the outside due to the vacuum created at the interface between the liquid 2 and that part of the piston 4 in contact with this liquid. To create this vacuum, it would, in fact, be necessary to exert a very considerable force of traction, far greater than the force due to the residual pressure.

Another advantage procured by the restrictor 48 provided in the outlet tube 46 is that it makes it possible, when this proves necessary, to eliminate any jet at the outlet of the container and to be able to have only a drop-by-flow, which is desirable in certain uses (in the case of eyedrops, for example).

In order to reinforce protection against penetration of germs and bacteria, there may also be provided in the outlet tube 46 a microfilter 51 of sufficient mesh dimension to oppose penetration of germs and bacteria inside the container, whilst allowing the liquid product to pass to the outside.

In order to be able to increase the residual pressure fairly substantially, non-return means may be provided in the container which firmly immobilize the piston in the position attained after the stroke having caused exit of the liquid. These non-return means may be of any appropriate type, such as a screwnut assembly, notches, rack, non-return elastic brake, elastic lip on the piston, etc. . . .

For example, FIG. 10 shows successive notches or teeth 10 formed on the inner face of the lateral wall of the container 1 and oriented in the direction of the outlet orifice, so as to oppose any movement of the piston 4 in opposite direction and to block it in the position attained.

Figure 11:
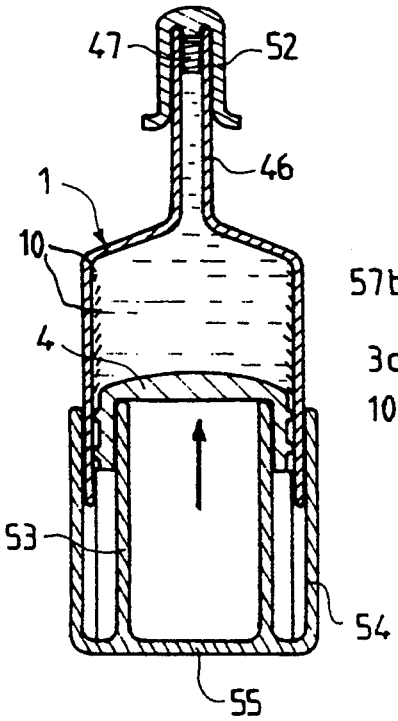

In the variant embodiment shown in FIG. 11, the outlet tube 46 is capped, during the period of non-use, by a protective cap 52 reinforcing protection against the penetration of germs and bacteria inside the container. Furthermore, piston 4 is fast with a coaxial inner sleeve 53 projecting outside the container, through its open end opposite its upper end wall and forming one piece with an outer peripheral skirt 54 made of supple material surrounding the lateral wall of the container 1. It is thus possible, by exerting a pressure on the outer end face 55 common to the sleeve 53 and to the skirt 54, to push the piston 4 towards the interior of the container 1, in order to cause the desired quantity of liquid to exit. There again, non-return notches or teeth 10 may be provided on the inner face of the wall of the container to block the piston 4 in the position attained.

Figure 12:
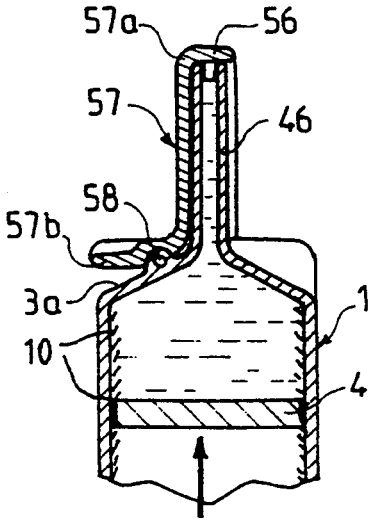

In the variant embodiment shown in FIG. 12, the orifice of the outlet tube 46 may be closed by a mobile obturator 56 of appropriate shape to engage in the outlet orifice. This obturator, which is manual or automatic, is designed so that its inner face rubs in tight manner on the outlet orifice and that, upon each use, it cuts off the flow of liquid exiting via the orifice upstream of the last drop used, with the result that the product remaining in the container has never been in contact with the air even in the course of use, which thus reinforces sterility of pouring. If there were no mobile obturator 56, several drops would continue to exit until the residual pressure of the liquid is balanced. This continuous flow of drops is cut off by the obturator and contributes to preventing germs and bacteria from penetrating in the container.

In order, in addition, to reinforce tightness, there may possibly be provided in the outlet orifice an additional valve which opens to allow the liquid to pass when a pressure is exerted on the piston and which automatically closes when this pressure is no longer exerted.

In the embodiment shown in FIG. 12, the mobile obturator 56 is provided at the end of the upper arm 57*a* of lever with two arms 57. The upper arm 57*a* of the lever 57 extends substantially in the immediate proximity of the outlet tube 46, in closed position, as shown in FIG. 12. The lever 57 also comprises a second, lower, actuation arm 57*b*, which is substantially horizontal, and it is mounted to pivot on the upper wall 3*a* of the container 1, about an axis 58. Consequently, a pressure on the lower actuation arm 57*b* of the lever 57 provokes a pivoting movement of this lever about axis 58, in anticlockwise direction, and opening of the outlet orifice. Elastic means may be provided to automatically return the lever 57 into position of closure.

Figure 13:
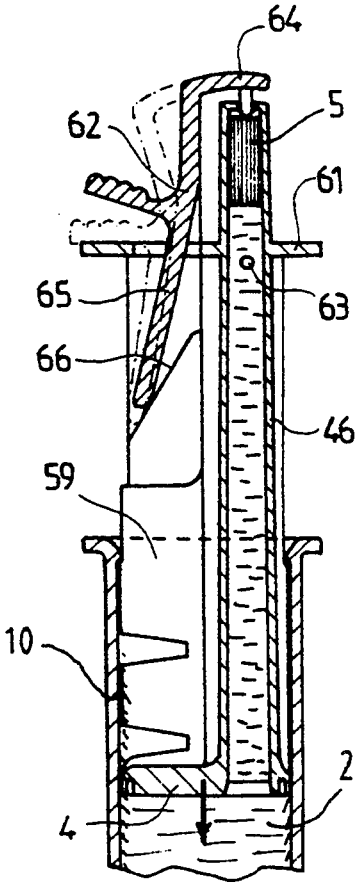

In the variant embodiment shown in FIG. 13, the piston 4 is fast with a rod 59 extending to the outside and bearing the outlet tube 46 for the liquid which passes through the piston 4. At the outer end of the rod 59 is provided a transverse flange 61 which is traversed by the outlet tube 46. This transverse flange 61 bears a lever 62 pivoting about an axis 63 and whose upper end forms an obturator 64 for closing the orifice of the outlet tube 46. The lever 62 is automatically returned into position of closure by elastic means. These elastic means may comprise, for example, a lower flexible tab 65 extending the pivoting lever 62 downwardly and sliding in contact with an inclined ramp 66 borne by the piston rod. Slide of the flexible tab 65 on the ramp 66, when lever 62 is pressed in order to open the obturator, provokes an elastic deformation of the tab 65, such deformation in turn causing the automatic return of the lever 62 of the obturator into position of closure. Non-return notches or teeth 10 may also be provided in this embodiment.

The aseptic container according to the invention may be used for mixing, at the moment of use, two liquids contained separately, at the moment of packaging, in two distinct compartments of the container, these compartments in that case being able to be placed in communication via appropriate tubes and obturators.

What is claimed:

1. An aseptic container, for containing a sterile liquid or semi-liquid product, said container comprising:

a body having a lateral wall obturated, at one end, by an end wall;

an internal mobile deformable piston having an outlet orifice including a narrow passage for evacuation of the product, said internal mobile deformable piston being made of elastic material upon which a pressure is exerted to expel the liquid or semi-liquid product, said piston being deformable under the action of pressure exerted, said piston being slidable within and in contact with said lateral wall, in a tight manner, against an inner surface of the lateral wall of said body, and said piston, said lateral wall and said end wall defining a containing volume for containing the product, an outlet tube having one end terminated by said outlet orifice, said outlet tube having its other end coupled to said containing volume and said piston having an inclined ramp;

pusher means for causing a sufficient force to be exerted on the piston, causing the containing volume to decrease and thereby expelling a desired quantity of the product from said containing volume, through said outlet orifice;

non-return means for maintaining said piston in its final position after the force exerted has stopped, for generating and holding a permanent residual pressure in the product, said residual pressure being due firstly to the deformation of the piston, secondly to the capillarity forces generated by the narrow passage of the outlet orifice, and thirdly to said non-return means, said residual pressure preventing germs and bacteria present in the ambient air from penetrating into the product and contaminating it;

a movable obturator sealingly sliding over said outlet orifice, said movable obturator cutting the stream of dispensed liquid upstream of the last drop, thus avoiding any contact of the liquid with the air and therefore giving a supplementary guarantee of sterility to the one already provided by the residual pressure;

a manoeuvering knob acting on a movable obturator flap of said movable obturator and on the piston so as concurrently to control opening of the movable obturator and the displacement of the mobile piston by a pressure exerted on the manoeuvering knob;

a two-armed movable lever, the obturator flap being fast with an arm of said lever; and elastic means for returning the two-armed lever and the manoeuvering knob into their normal positions of closure, said elastic means including a flexible tab slidable on said inclined ramp, said flexible tab being deformable when said lever is pressed to provoke an elastic deformation of said tab causing an automatic return of said lever.

2. The container of claim 1, comprising:

a rod fast with the piston, extending outside the container and bearing the outlet tube for the product which traverses the piston;

a transverse flange provided at the outer end of the rod and traversed by the outlet tube; and said lever being mounted to pivot on said flange and of which one end forms the obturator for closing the orifice of the outlet tube.

3. The container of claim 1, comprising a microfilter of sufficient mesh dimension to oppose penetration of the germs and bacteria inside the container, whilst allowing the liquid product to pass to the outside.

* * * * *